US006547433B2

(12) United States Patent
Yazici et al.

(10) Patent No.: US 6,547,433 B2
(45) Date of Patent: Apr. 15, 2003

(54) AIR MIXING DEVICE HAVING SERIES OF PARALLEL AIRFLOW PASSAGES

(75) Inventors: Muammer Yazici, Etobicoke (CA); Ming Hui Han, Mississauga (CA)

(73) Assignee: M & I Heat Transfer Products, Ltd., Mississauga (CA)

( * ) Notice: Subject to any disclaimer, the term of this patent is extended or adjusted under 35 U.S.C. 154(b) by 161 days.

(21) Appl. No.: 09/754,915

(22) Filed: Jan. 5, 2001

(65) Prior Publication Data

US 2002/0126572 A1 Sep. 12, 2002

(51) Int. Cl.[7] ..... B01F 5/00; F24F 13/04
(52) U.S. Cl. ..... 366/336; 366/338; 454/261
(58) Field of Search ..... 366/107, 336, 366/338; 454/228, 261, 262, 263, 269, 264, 265; 165/59

(56) References Cited

U.S. PATENT DOCUMENTS

| | | | |
|---|---|---|---|
| 1,395,938 | A | 11/1921 | Barducci |
| 2,400,617 | A | 5/1946 | Wheller |
| 3,386,366 | A | 6/1968 | Economides et al. |
| 3,405,758 | A | 10/1968 | Walker et al. |
| 3,911,804 | A | 10/1975 | Tao |
| 4,078,576 | A | 3/1978 | Punch et al. |
| 4,150,817 | A | 4/1979 | Regelin et al. |
| 4,352,321 | A | 10/1982 | Fukui et al. |
| 4,495,858 | A | 1/1985 | Erickson |
| 4,793,247 | A | 12/1988 | Verweij |
| 5,368,521 | A | 11/1994 | Koenig |
| 5,463,967 | A | 11/1995 | Gielow et al. |
| 5,632,675 | A | 5/1997 | Kanninen et al. |
| 5,988,263 | A | 11/1999 | Schwarz |
| 6,139,425 | A | 10/2000 | Yazici et al. |

FOREIGN PATENT DOCUMENTS

| | | |
|---|---|---|
| DE | 2844046 | 4/1980 |
| SU | 688786 | 9/1979 |
| WO | WO 89/03006 | 4/1989 |

*Primary Examiner*—Joseph W. Drodge
(74) *Attorney, Agent, or Firm*—Barry R. Lipsitz

(57) ABSTRACT

An air mixer for an air distribution system for a building including a set of fixed, parallel partitions arranged in a spaced-apart manner with one above another, these partitions forming alternating primary and secondary air passageways that are capable of conveying first and second air flows respectively. These passageways are substantially open ended at both inlet and outlet ends thereof. The primary air passageways extend from a first side of the mixer to a third, outlet side while the secondary air passageways extend at a substantial angle to the primary passageways from a second side to the third outlet side. There are fixed mixing devices, preferably in the form of curved vanes, arranged at many of the outlet ends of the passageways. The preferred air mixer has a substantially triangular shape in plan view.

18 Claims, 3 Drawing Sheets

AIR MIXING DEVICE HAVING SERIES OF PARALLEL AIRFLOW PASSAGES

BACKGROUND OF THE INVENTION

This invention relates to air mixers for mixing together two different air flows, particular air mixers for an air distribution system suitable for a building or other similar structure.

In air handling systems designed for large buildings such as office towers and other large structures, there has been a need to mix together at least two different air flows before distributing the mixed air flow throughout the air ducts of the building by means of a fan. Although various air mixers have been developed for bringing together and mixing two different air streams, these known air mixers tend to be inefficient or else they require a substantial amount of space in the building in order to operate in the intended manner. The most common types of air streams to be mixed in an air handling system are return air flow that is coming back from the interior of the building and a fresh outside air flow. It will be appreciated that in cold weather, the return air would normally be relatively warm, for example room temperature, while the outside air can be quite cold.

In these air handling systems for buildings, air stratification that results from a momentum inherent in moving air streams can keep air streams of different temperatures from mixing for quite some distance. This in turn can cause the air handling system to operate poorly or inefficiently and can also result in poor indoor air quality. Also during the winter time, lack of proper mixing of the incoming air streams can result in freezing or damage of heating coils that are part of the heating system and can generate control sensor errors. In the summer, lack of proper mixing of the air streams can result in poor indoor air temperature control and can increase the energy consumption of the air conditioning system. It should be appreciated that the heat transfer capacities at the cooling coils are based on air flow at uniform temperature and velocity across the coils. Thus a non-uniform temperature distribution for the entering air can cause reduced heat transfer of the coils and the desired temperature in the building may not be maintained.

These mixing problems can become more serious as the amount of outdoor air is increased in the air distribution system. Both government regulations and building users are now often requiring a greater amount of outdoor air.

Recent U.S. Pat. No. 5,463,967 issued Nov. 7, 1995 to Airflow Sciences Corporation describes a static mixer designed for use with a power plant. This mixer has a series of parallel walls arranged in side-by-side spaced apart relationship to form a series of rectangular spaces. The perimeters of these spaces are selectively closed to define respective first and second inlets located on two sides and an outlet located on a third side of the air mixer. This mixer creates interleaving of the two air streams and thus promotes increased homogeneity some distance downstream of the confluence of these streams.

In commonly assigned U.S. patent application Ser. No. 09/298,377 filed Apr. 23, 1999 now U.S. Pat. No. 6,139,425, there is described another static mixer which is capable of properly mixing two different air streams within the mixer itself. This known air mixer employs a set of fixed, parallel partitions arranged in spaced apart, side-by-side manner, these partitions forming alternating primary and secondary air passageways. The primary passageways are open ended and extend from a front side of the mixer to a rear side thereof. There is a side wall located on one side of the air mixer that closes the air passageways on this side and that extends from the front side of the mixer to the rear side. Front end plates extend longitudinally across the front side of the air mixer and extend transversely and respectively across sides of the secondary air passageways. These end plates have elongate edge portions extending along longitudinal edges thereof with each edge portion projecting in a transverse direction beyond the plane defined by an adjacent one of the partitions. Air gaps are formed between the elongate edge portions and front edges of the partitions to enable the air flow in the secondary air passageways to exit therefrom and be mixed in the primary air passageways with air flow passing through the latter passageways. This air mixer can also be equipped with a series of turbulence creating plates mounted within the primary air passageway and distributed across the width of their respective primary air passageways.

Although the aforementioned static air mixer works quite well for air system applications where the outside air ratio as a percentage of total air flow is less than 60 percent, this known air mixer does not work as well in conditions where it is desirable to have all or substantially all of the downstream air flow comprised of outside air. This known mixer may cause a high pressure drop when there is a high volume of outside or secondary air passing through the secondary airflow passages. This situation could for example be encountered where the outside air temperature is the same as or close to the temperature required within the building itself. Under such conditions where 100% outside air is desired, the aforementioned known air mixer generally requires the use of outside air bypass dampers to allow for outside air to enter the air distribution system without passing through the static air mixer.

It is an object of the present invention to provide an improved air mixer that can help avoid undesirable air stratification in an air distribution system and at the same time has low pressure drop whatever the ratio of or percentage of primary airflow and secondary airflow may be.

It is a further object of the present invention to provide a novel air mixer for an air distribution system that employs fixed air mixing devices in the outlet side of the air mixer and that can be manufactured at a reasonable cost.

SUMMARY OF THE INVENTION

According to one aspect of the present invention, an air mixer for an air distribution system for a building or similar structure includes a set of fixed, substantially parallel partitions arranged in a spaced-apart manner with one above another. These partitions form alternating primary and secondary air passageways that are capable of conveying first and second air flows respectively. These air passageways are substantially open ended at both inlet and outlet ends. The primary air passageways extend from a first side of the air mixer to a third, outlet side while the secondary air passageways extend at a substantial angle to the primary air passageways and from a second side of the air mixer to the third, outlet side. This apparatus also has fixed air mixing devices arranged at at least a substantial portion of the outlet ends of at least one of the primary air passageways and the secondary air passageways. These air mixing devices are adapted and arranged to mix together the first and second air flows. The air mixer has a substantially triangular shape in plan view, this shape being defined by the aforementioned first, second and third sides.

In a preferred embodiment, the air mixing devices are a plurality of spaced-apart vanes mounted at the outlet ends of the secondary air passageways.

According to another aspect of the invention, an air mixer for a distribution system for a building or similar structure includes a first set of air ducts forming air flow passageways for a first airflow, this first set forming two or more spaced-apart levels of air ducts that extend from a first intake side of the air mixer to an outlet side thereof. A second set of air ducts forms air flow passageways for a second air flow, the second set forming two or more spaced-apart levels of air ducts that alternate with the levels of the first set. The second set of air ducts extend from a second intake side of the air mixer to the outlet side and extend at a substantial angle of up to about 90 degrees to the first set. This air mixer includes fixed air flow mixing devices for mixing the first and second air flows rigidly mounted at outlet ends of at least a substantial portion of the air ducts of the first set or the second set.

In a preferred embodiment the mixing devices comprise a series of curved vanes arranged at each level of the first set or the second set, these vanes acting to redirect the air flow exiting from the outlet ends of at least said substantial portion of the air ducts.

According to a further aspect of the invention, an air mixer for an air distribution system for a building or similar structure includes two adjacent sets of air ducts forming air flow passageways for first and second air flows. One of these sets is oriented at a substantial angle, that is less than 180 degrees, to the other of the sets and each air duct has an inlet end and an outlet end. The inlet ends of one set of air ducts are located on a first side of the air mixer, which has a triangular shape when viewed from above. The inlet ends of the other set are located on a second side of the air mixer while the outlet ends of both sets are located on a third side of the air mixer. Air deflecting vanes for the mixing of the first and second air flows are mounted at at least a portion of the outlet ends on the third side. These deflecting vanes in use act to redirect at least a portion of one of the first and second air flows towards the other of the first and second air flows at the third side of the air mixer.

Further features and advantages of the invention will become apparent from the following detailed description taken in conjunction with the accompanying drawings.

DETAILED DESCRIPTION OF PREFERRED EMBODIMENT

Figure 2:
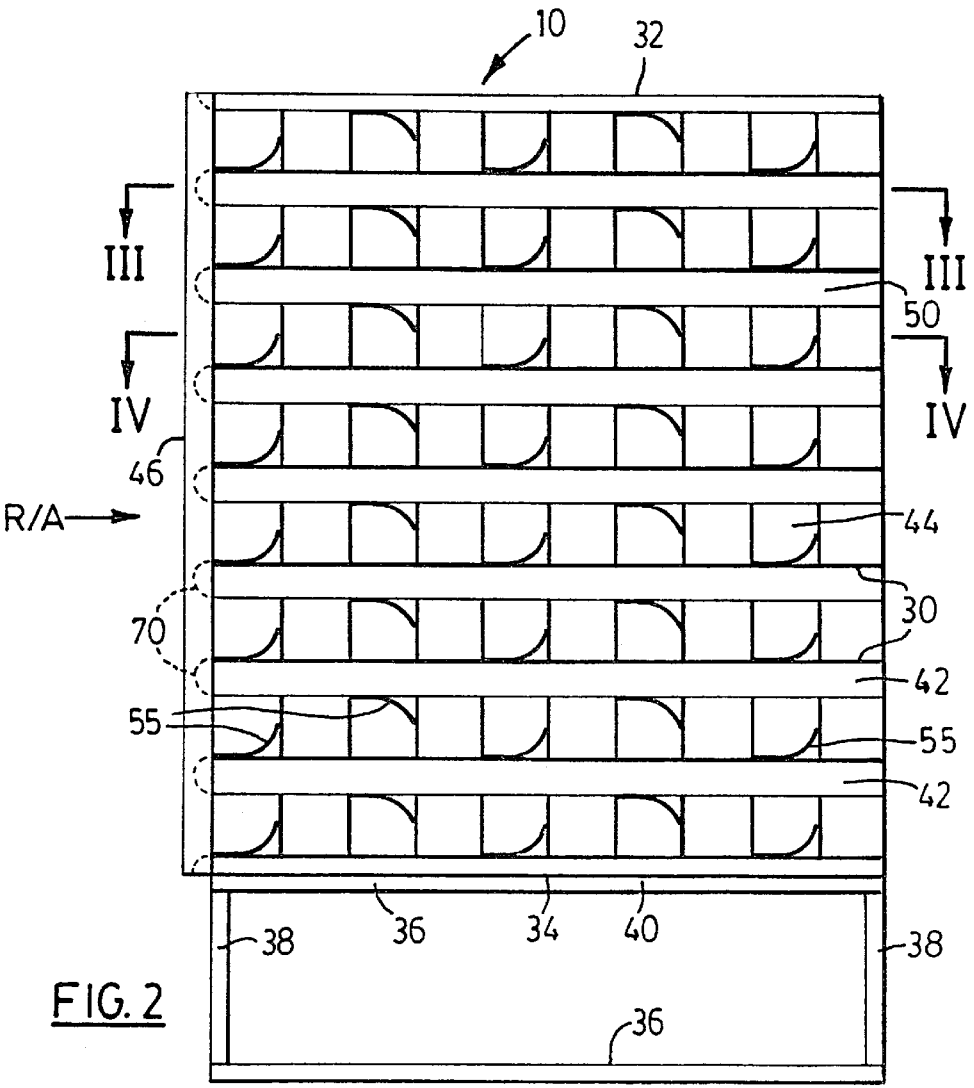
FIG. 2 is a side elevation of an air mixer constructed in accordance with the invention, this view showing the outlet side.
Figure 1:
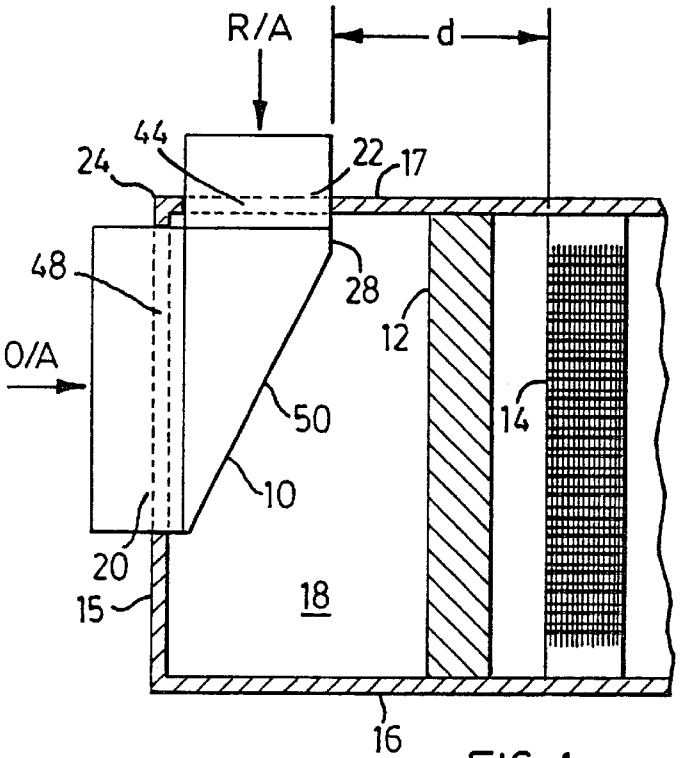
FIG. 1 is a schematic plan view illustrating an air mixer constructed in accordance with the invention installed in a corner of a plenum chamber of an air distribution system.
Figure 3:
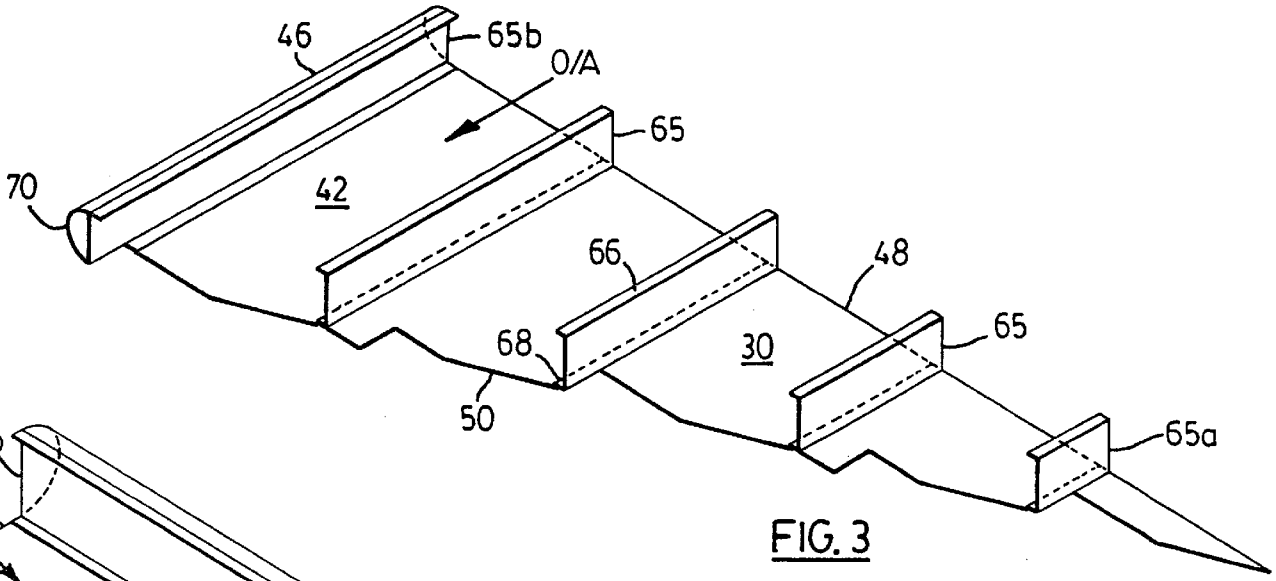
FIG. 3 is an isometric view showing a portion of the air mixer of FIG. 2, this view being taken along the lines III—III of FIG. 2.
Figure 4:
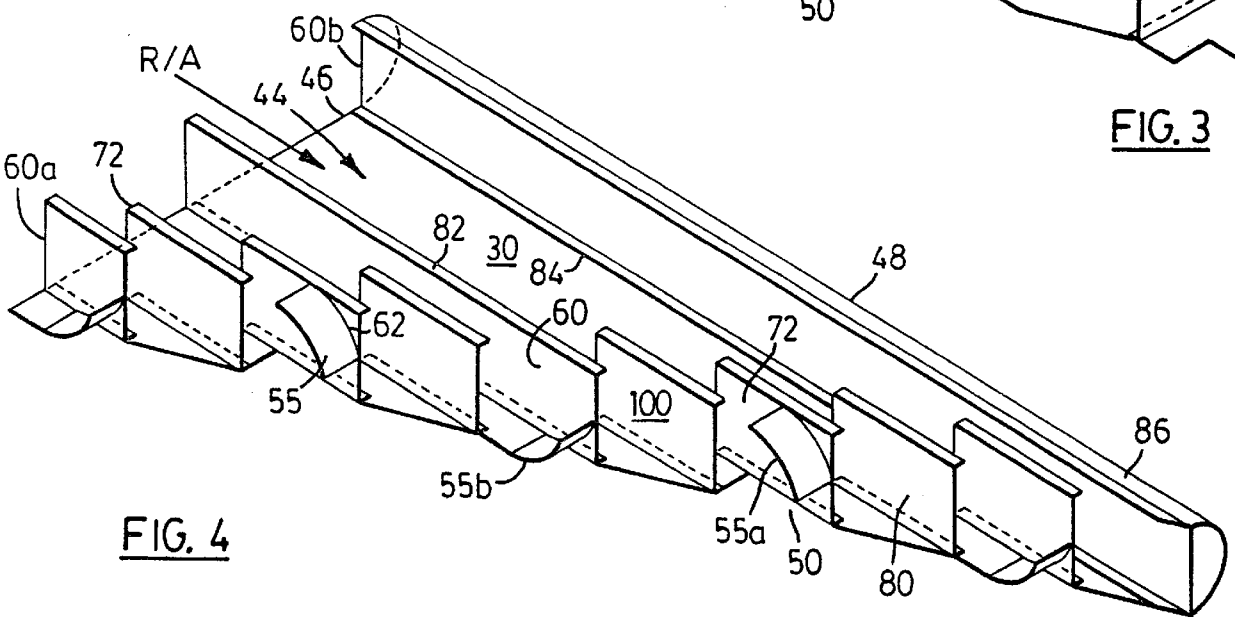
FIG. 4 is another isometric view showing another level of the air mixer, this view being taken along the line IV—IV of FIG. 2.
Figure 5:
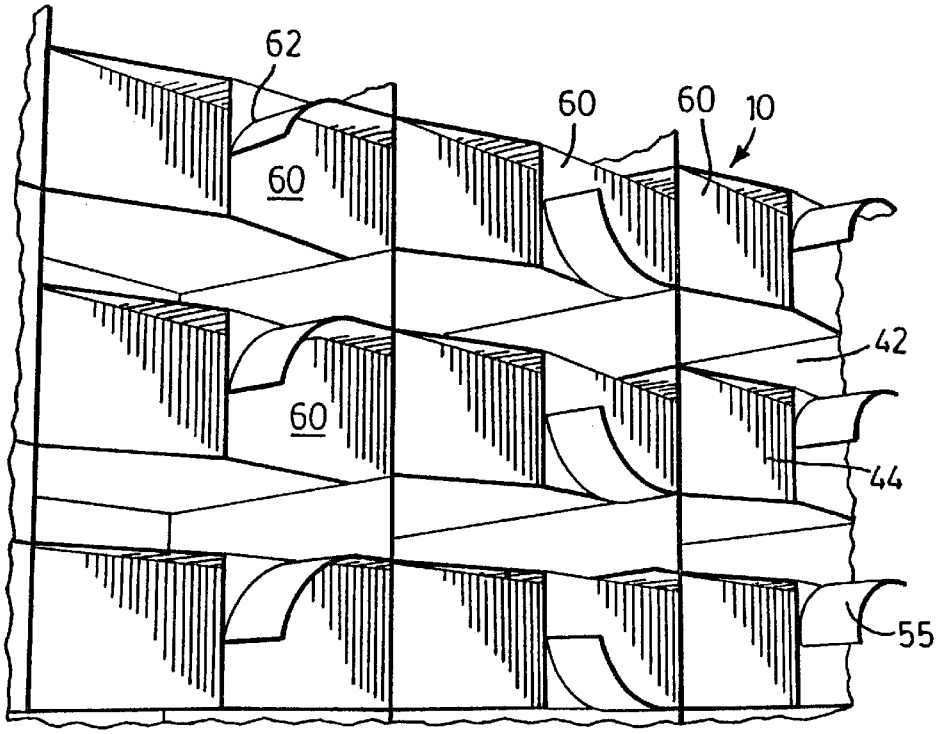
FIG. 5 is a perspective view showing a portion of an outlet side of the preferred air mixer of the invention.

An air mixer 10 constructed in accordance with the invention is illustrated in FIG. 2 with two different levels thereof illustrated in FIGS. 3 and 4. This air mixer is particularly useful for an air distribution system for a building or similar structure. FIG. 1 illustrates schematically how the air mixer 10 can be used in a plenum chamber in which a plenum fan, for example can be installed. Although the fan is not illustrated in FIG. 1, it will be understood that this fan typically would be installed on the right side of the plenum chamber, this side not being shown in FIG. 1. Illustrated in FIG. 1 is a bank or wall of standard air filters 12 and, spaced-apart from the filters, an array of cooling and/or heating coils 14. It will be understood that mixed air exiting from the air mixer 10 is then forced to pass through the air filters and the cooling and/or heating coils to the fan. The plenum chamber commonly includes side walls or panels, three of which are illustrated at 15 to 17. The plenum chamber also has a floor 18 and a ceiling (not shown). The outlet of the plenum fan is connected to air ducts or an air duct silencer to delivery the required air to the building.

Also illustrated in FIG. 1 is a first air inlet 20 located in the side wall 15 of the plenum chamber and a second air inlet 22 located in the side wall 17. As illustrated these two inlets are located close to a corner 24 of the plenum and it is in this corner of the plenum chamber that the air mixer 10 is installed and is typically supported by the floor 18 of the plenum chamber. The side walls can be insulated, if desired to reduce the amount of sound emanating from the chamber which contains the aforementioned fan. The fan typically is either a centrifugal fan or an axial type fan having the required capacity to deliver the desired amount of air to the building. Normally the fan system is part of an air conditioning and/or heating system for the building or structure. As illustrated the bank of heat exchanging coils at 14 is mounted a distance "d" from the nearest corner 28 of the air mixer.

In a standard air distribution system one of the two air inlets is for return air that is coming back to the plenum chamber from the building itself and the other air inlet is for fresh outside air. In the illustrated version of FIG. 1, the narrower inlet 22 is being used for return air while the wider inlet 20 is being used for outside air. Which air inlet is chosen for a particular air flow will depend upon what the building layout requires. It will be appreciated that depending upon outside temperature conditions, there can be a substantial temperature difference between the return air flow and the outside air flow. Normally the return air will be a temperature that is close to normal room temperature, for example, around 20 degrees Celsius or 70 degrees Fahrenheit. If winter conditions exist outside, the temperature of the outdoor air could be close to or below the freezing point. On the other hand, if it is a warm summer day, the outside air could have a temperature of 30 degrees Celsius or more. It will be apparent that the mixture of the two air flows must generally be warmed by the heat exchanging coils at 14 (or other means) before the air mixture is distributed back into the building by the fan in the winter time. Alternatively, the heat exchanging coils 14 must cool the air mixture to some extent before it is blown through the building by the fan in the summer time. It should also be appreciated that under some conditions, it may be desirable to deliver air to the interior of the plenum chamber and to the fan which is 100% outside air or which is nearly 100% outside air. This may be desirable for example when the outside air is close to the desired room temperature. The air mixer fan of the present invention is particularly suitable for use in a plenum chamber where these conditions will often be encountered since the preferred version of the present air mixer can handle 100% outside air at a low pressure drop.

Turning now to the construction of the air mixer 10, it is made with a set of fixed, substantially parallel partitions or panels 30 that are arranged in a spaced-apart manner with one above another. The number of these panels can vary depending on the various job requirements with the illustrated air mixer of FIG. 2 having 16 or more of these panels which, in a preferred embodiment, are substantially triangular. The illustrated air mixer includes a horizontal top panel at 32 and a bottom panel at 34. In order that the air mixer is located at the proper height above the floor of the plenum, it can be mounted on a metal support structure that typically can be made of horizontal, bottom frame members 36 (only one of which is shown) and vertical steel posts or frame members 38. Rigidly connecting the top of the posts 38 are horizontal connecting frames 40 (again only one is shown for ease of illustration). The bottom panel 34 is rigidly mounted on the top of the connecting frame members 40.

The partitions 30 form alternating primary air passageway 42 and secondary air passageway 44, these passageways being capable of conveying first and second airflows respectively. As illustrated in FIG. 2, the return air enters the air mixer 10 through one vertical side 46 and passes through the secondary air passageways 44. The primary air passageways 42 extend from a side 48 of the air mixer to an outlet side 50 thereof. In the case of the preferred air mixer 10 which is triangular in plan view, the outlet side 50 is the long side of the triangle and, in the illustrated embodiment, where the air mixer 10 is the shape of a right angled triangle in plan view, the side 50 is the hypotenuse in this triangle. The secondary air passageways 44 extend at a substantial angle to the primary air passageways 42 and, in the illustrated preferred embodiment, this angle is 90 degrees. As also illustrated in FIG. 4, the secondary air passageways extend from the side 46 of the air mixer to the third outlet side 50.

The air mixer 10 has fixed mixing devices 55 arranged at at least a substantial portion of the outlet ends of at least one of the primary passageways 42 and the secondary air passageways 44. These air mixing devices 55 are adapted and arranged to mix together the first and second air flows. In the illustrated embodiment the mixing devices 55 are provided at a substantial portion of the outlet ends of the secondary air passageways 44 and there are none located directly outwardly from the outlet ends of the primary air passageways 42 but it will be understood by those skilled in the art that these mixing devices can, if desired, also be located at some or all of the outlet ends of the primary air passageways 42. The preferred illustrated air mixing devices are a plurality of spaced-apart vanes in the form of bent metal plates mounted at the outlet ends. The preferred vanes 55 are curved with a portion of the vanes deflecting the second air flow (for example the return air flow) upwardly and the remaining portion of the vanes deflecting the second air flow downwardly. In one preferred embodiment, the vanes 55 are integral, curved extensions of the partitions 30. One side of each bent vane 55 can be rigidly connected to an adjacent divider wall 60 or 72 that extends vertically between two adjacent partitions and is connected thereto. These vanes and the divider walls are preferably made from sheet metal and thus the curved edge 62 of each vane can be welded to the adjacent divider wall to hold the vane firmly in place and reduce or eliminate vibration of the vane. As illustrated in FIGS. 2 and 4, every other vane 55 at each level can be bent downwardly (see for example vane 55*a*) while the vanes 55*b* located between them bend upwardly.

As illustrated in FIGS. 3 and 4, in the preferred air mixer, each of the primary and secondary air passageways, 42,44 is divided into smaller air passageways by a plurality of dividing walls including the aforementioned divider walls 60. A plurality of these dividing walls in fact extend between the inlet ends and the outlet ends of the respective primary or secondary air passageway.

With reference to FIG. 3 which illustrates the construction of the primary air passageways 42, the passageways 42 are separated at the same level of the air mixer by dividing walls 65 which vary in length from a short wall 65*a* to a long side wall 65*b* located adjacent the side 46 of the air mixer. Each of these walls 65 can be formed with upper and lower edge flanges 66 and 68 that are used to rigidly attach the dividing wall to the adjacent partitions 30 (only one of which is shown in FIG. 3). In a preferred embodiment, both the partitions and the dividing walls 60, 65 are constructed of 22 gauge galvanized or aluminum sheet metal and the partitions and dividing walls are securely fastened together by tek screws, rivets and/or spot welding using the flanges 66,68. Connected to one side of the partitions 30 or directly to the long side walls 65*b* are horizontally extending, curved nose plates 70 which can also be seen in dashed lines in FIG. 2. These nose plates act to guide and direct the incoming return air into the secondary air passageways 44. The preferred illustrated nose plates have a semi-cylindrical shape. It will be appreciated that the nose plates 70 extend between the secondary air passageways 44 at the side 46 of the air mixer.

Turning to FIG. 4, the divider walls 60 also vary in length from a very short divider wall 60*a* to a long, side wall 60*b* that extends along the side 48 of the air mixer. However, in this embodiment, there are also relatively short intermediate divider walls indicated at 72. As illustrated, there are three or four of these intermediate walls 72 between adjacent divider walls 60 that extend from the inlet ends to the outlet ends. One of each group of divider walls 72 can be used to support one of the curved vanes 55 as illustrated in FIG. 4. It will be understood that both the intermediate divider walls 72 and the walls 60 serve to maintain a relatively uniform air flow distribution as the return air passes through the secondary air passageways 44. Thus the amount of return air that exits from each of the outlet openings 80 along the side 50 is substantially the same. Similarly, the aforementioned divider walls 65 help to maintain a relatively uniform air flow distribution through the primary air passageways 42. All of these divider walls also help to support the horizontal partitions 30 to which they are attached and help to prevent the vibration in these partitions.

Preferably the divider walls 60 and the intermediate dividers 72 are also formed with upper and lower edge flanges 82 and 84 in order to connect these walls to the adjacent partitions. These flanges can be rigidly connected to the partitions by tek-screws, rivets and/or spot welding.

Figure 6:
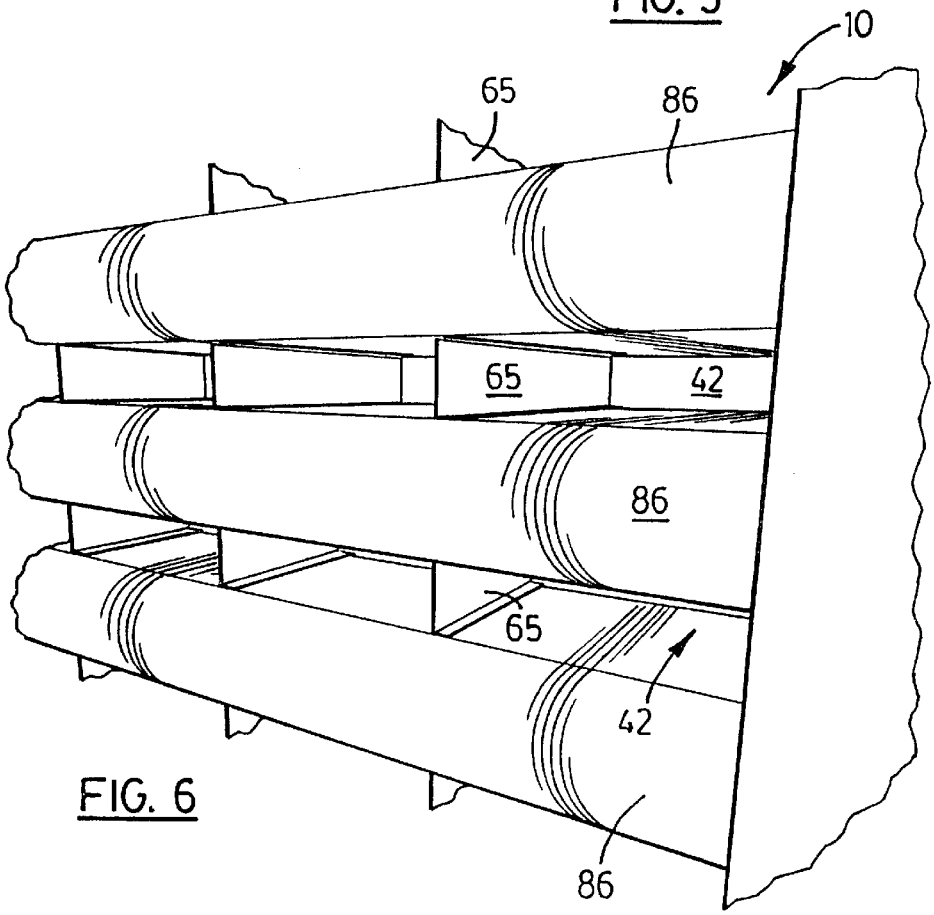
FIG. 6 is another perspective view showing one of the inlet sides of the air mixer.

Preferably there is mounted on the outside surface of each of the long side walls 60*b* a horizontally extending, curved nose plate 86 which can have a semi-cylindrical shape. A few of these nose plates 86 are illustrated in FIG. 6. These nose plates act to guide the incoming outside air into the primary air passageways 42. The nose plates 86 extend between the primary air passageways 42 at the side 48 of the air mixer.

The illustrated preferred primary and secondary air passageways 42, 44 are substantially straight between their respective inlet and outlet ends as can be seen from FIGS. 3 and 4. By using straight air passageways, these passageways can be constructed relatively easily and at a reasonable cost using standard manufacturing techniques. However it is always possible that either the primary or the secondary air passageways can be made so that they are curved from their inlet ends to their outlet ends. Such curvature of the air passageways might be required for some job applications in order to meet certain design criteria.

It will be understood as well that the air mixer of this invention can also be considered as two sets of air ducts formed by the aforementioned partitions 30 and the divider walls 60 and 65. Thus a first set of air ducts forms air flow passageways 42 for a first air flow and this first set forms two or more spaced-apart levels of air ducts that extend from first intake side 48 of the air mixer to the outlet side 50. A second set of air ducts forms the air flow passageways 44 for the secondary air flow. Again this set forms two or more spaced apart levels of air ducts that alternate with the levels of the first set. The second set extends from the second intake side 46 of the air mixer to the outlet side 50 and these air ducts extend at a substantial angle of up to about 90 degrees to the air ducts of the first set. The fixed air flow mixing devices 55 mix the first and second air flows and are rigidly mounted at the outlet ends of at least a substantial portion of the air ducts of the first set or the second set. These mixing devices, preferably in the form if the curved vanes 55 can be arranged at each level of the first set or the second set of air ducts and they act to redirect the air flow exiting from the adjacent outlet ends.

In the preferred triangular air mixer that is illustrated, the two shorter sides, 46,48 are first and second intake sides of the air mixer and the mixing devices or vanes 55 are distributed over the long side 50.

It will be understood that if one considers the present air mixer as having two adjacent sets of air ducts forming air flow passageways, one of these sets is oriented at a substantial angle, that is less than 180 degrees, to the other of the sets. Each of these air ducts has an inlet end and an outlet end. It should also be noted that the preferred mixing devices 55 act as air deflecting vanes for the mixing of the first and second air flows and these vanes in use act to redirect at least a portion of one of the first and second air flows towards the other of the first and second air flows at the third or outlet side of the air mixer. Note that in the illustrated preferred embodiment, there are a number of outlet openings 100 located at ends of secondary air passageways 44 where there is no deflecting vane and the return air simply passes directly through these outlet openings. In this way the return air exits from the air mixer in several different directions and this helps to ensure a good mixing of the two air flows.

It will be understood that a proper distance d needs to be provided in the design of the plenum chamber and the air mixer in order to provide uniform air flow at the downstream components such as the heat exchanging coils, particularly when the air mixer selected is smaller than these components.

In order to provide some typical examples of the performance of air mixers constructed in accordance with the invention, set out in Table 1 below are three different models of the air mixer indicated by model numbers B-5, B-10 and B-15. The dimensions of these three air mixers are provided for two different sizes of air plenums. The meaning of the column headings is set out below:

$W_O$=width facing O/A dampers $W_r$=width facing R/A dampers h=height d=minimum distance to coils downstream

TABLE 1

| | Plenum | | Mixer Dimensions | | | | |
|---|---|---|---|---|---|---|---|
| Model No. | H In. | W In. | Wo In. | Wr In. | h In. | d In. | Weight Lb |
| B-5 | 60 | 60 | 34.5 | 21 | 33 | 30 | 68 |
| | 60 | 72 | 34.5 | 21 | 44 | 30 | 89 |
| B-10 | 72 | 72 | 42.5 | 25 | 44 | 30 | 113 |
| | 72 | 84 | 42.5 | 25 | 55 | 30 | 139 |
| B-15 | 72 | 96 | 54.5 | 29 | 55 | 36 | 183 |
| | 84 | 84 | 54.5 | 29 | 66 | 36 | 217 |
| | 84 | 96 | 54.5 | 29 | 77 | 36 | 250 |

The pressure drop indicated by tests run on these three air mixers is indicated in Table 2 below.

TABLE 2

| | PRESSURE DROP ("WG") | | | | | | | |
|---|---|---|---|---|---|---|---|---|
| | CFM | | | | | | | |
| Model No. | 0.06 | 0.09 | 0.10 | 0.12 | 0.14 | 0.17 | 0.19 | 0.22 |
| B-5 | 4383 | 5156 | 5672 | 6168 | 6703 | 7219 | 7734 | 8250 |
| | 5844 | 6875 | 7563 | 8250 | 8938 | 9625 | 10313 | 11000 |
| B-10 | 7055 | 8328 | 9175 | 10021 | 11711 | 12339 | 12555 | 13398 |
| | 8818 | 10410 | 11469 | 12527 | 13583 | 14639 | 15693 | 16748 |
| B-15 | 10246 | 12155 | 13420 | 14681 | 15939 | 17196 | 18449 | 19701 |
| | 12295 | 14586 | 16104 | 17618 | 19127 | 20634 | 22138 | 23641 |
| | 14345 | 17017 | 18788 | 20554 | 22315 | 24073 | 25828 | 27581 |

Indicated data are the maximum pressure drops, which corresponds to a minimum 20% outside air ratio.

The pressure drops across the mixer is determined by the total air volume and the outside air ratio. Table 2 shows the pressure drops across an air mixer constructed in accordance with the invention at various total air volumes and outside air ratios.

The present air mixer takes advantage of heat exchange through thin sheet metal, the interaction of air streams and the use of sheet metal mixing devices that accelerate the air mixing process. There is a low pressure drop in the mixer itself and there is no extra pressure drop created at the filter and coil sections in the plenum (because of the uniform downstream velocity profile).

It will be understood that although the illustrated air mixer has primary air passageways 42 which have a predetermined first height which is less than the predetermined second height for each of the secondary air passageways, it is also possible for these two sets of air passageways to have the same height. The relative heights and the actual heights that are chosen will depend on the particular application and the site requirements for the air mixer. Also although the illustrated and described air passageways in the air mixer extend horizontally, it is also possible for at least one set of passageways to extend vertically, for example, where one airflow enters the plenum through an opening in the ceiling.

It will be appreciated by those skilled in this art that various modifications and changes can be made to the described air mixer without departing from the spirit and scope of this invention. Accordingly all such modifications and changes that fall within the appended claims are intended to be part of this invention.

We claim:

1. An air mixer for an air distribution system for a building or similar structure, comprising:

a set of fixed, substantially parallel partitions arranged in a spaced-apart manner with one above another, said partitions forming alternating primary and secondary air passageways that are capable of conveying first and second airflows respectively and that are substantially open ended at both inlet and outlet ends thereof, said primary air passageways extending from a first side of said air mixer to a third, outlet side, said secondary air passageways extending at a substantial angle to said primary air passageways and from a second side of said air mixer to said third, outlet side; and fixed air mixing devices arranged at a substantial portion of the outlet ends of at least one of said primary air passageways and said secondary air passageways, said air mixing devices being adapted and arranged to mix together the first and second airflows;

wherein said air mixer has a substantially triangular shape in plan view, said triangular shape being defined by said first, second, and third sides.

2. An air mixer according to claim 1 wherein said air mixing devices are a plurality of spaced-apart vanes mounted at the outlet ends of the secondary air passageways.

3. An air mixer according to claim 2 wherein each of said primary and secondary air passageways formed by an adjacent pair of said partitions is divided into smaller air passageways by a plurality of dividing walls that extend between said inlet and outlet ends of the respective primary or secondary air passageway.

4. An air mixer according to claim 3 wherein a plurality of horizontally extending, curved nose plates extend between said primary air passageways at the first side of the air mixer and a plurality of horizontally extending, curved nose plates extend between said secondary air passageways at the second side of the air mixer.

5. An air mixer according to claim 3 wherein both said primary and secondary air passageways are substantially straight between their respective inlet and outlet ends.

6. An air mixer according to claim 2 wherein said vanes are curved with a portion of the vanes deflecting said second airflow upwardly and a remaining portion of the vanes deflecting said second airflow downwardly.

7. An air mixer according to claim 2 wherein said vanes are integral, curved extensions of said partitions.

8. An air mixer according to claim 7 wherein each of said vanes is rigidly connected to an adjacent divider wall that extends vertically between two adjacent partitions and is connected thereto.

9. An air mixer according to claim 2 wherein said parallel partitions are spaced apart in such a manner that the primary air passageways each have a predetermined first height which is less than a predetermined second height for each of the secondary air passageways.

10. An air mixer according to claim 1 wherein said air mixer has the shape of a right-angled triangle in plan view with the third, outlet side extending along the hypotenuse.

11. An air mixer for an air distribution system for a building or similar structure, said air mixer comprising:

a first set of air ducts forming airflow passageways for a first airflow, said first set forming two or more spaced-apart levels of air ducts that extend from a first intake side of the air mixer to an outlet side thereof;

a second set of air ducts forming airflow passageways for a second airflow, said second set forming two or more spaced apart levels of air ducts that alternate with the levels of the first set, said second set of air ducts extending from a second intake side of the air mixer to said outlet side and extending at a substantial angle of up to about 90 degrees to the air ducts of the first set; and fixed airflow mixing devices for mixing the first and second airflows rigidly mounted at outlet ends of at least a substantial portion of the air ducts of the first set or the second set, said mixing devices comprising a series of curved vanes arranged at each level of the first set or the second set, said curved vanes acting to redirect the airflow exiting from said outlet ends of said at least a substantial portion of the air ducts, wherein said air mixer has a triangular shape in plan view, said triangular shape having one long side corresponding to said outlet side and two shorter sides corresponding to said first intake side and said second intake side, and wherein said mixing devices are distributed over said long side.

12. An air mixer according to claim 11 wherein said air mixer has the shape of a right-angled triangle in plan view and each level of air ducts comprises at least several parallel air ducts that are separated from one another by vertical divider walls that vary in length.

13. An air mixer for an air distribution system for a building or similar structure, said air mixer comprising:

a first set of air ducts forming airflow passageways for a first airflow, said first set forming two or more spaced-apart levels of air ducts that extend from a first intake side of the air mixer to an outlet side thereof;

a second set of air ducts forming airflow passageways for a second airflow, said second set forming two or more spaced apart levels of air ducts that alternate with the levels of the first set, said second set of air ducts extending from a second intake side of the air mixer to said outlet side and extending at a substantial angle of up to about 90 degrees to the air ducts of the first set; and fixed airflow mixing devices for mixing the first and second airflows rigidly mounted at outlet ends of at least a substantial portion of the air ducts of the first set or the second set, said mixing devices comprising a series of curved vanes arranged at a level of the first set or the second set, said curved vanes acting to redirect the airflow from said outlet ends of said at least a substantial portion of the air ducts, wherein a portion of each series of curved vanes curve upwardly so as to redirect the airflow exiting from the adjacent outlet ends upwardly and a remaining portion of each series of curved vanes curve downwardly so as to redirect the airflow exiting from the adjacent outlet ends downwardly.

14. An air mixer for an air distribution system for a building or similar structure, said air mixer comprising:

a first set of air ducts forming airflow passageways for a first airflow, said first set forming two or more spaced-apart levels of air ducts that extend from a first intake side of the air mixer to an outlet side thereof;

a second set of air ducts forming airflow passageways for a second airflow, said second set forming two or more spaced apart levels of air ducts that alternate with the levels of the first set, said second set of air ducts extending from a second intake side of the air mixer to said outlet side and extending at a substantial angle of up to about 90 degrees to the air ducts of the first set; and fixed airflow mixing devices for mixing the first and second airflows rigidly mounted at outlet ends of at least a substantial portion of the air ducts of the first set or the second set, wherein both sets of air ducts form horizontal airflow passageways separated by sheet metal panels that form top and bottom sides of said air ducts.

15. An air mixer for an air distribution system for a building or similar structure, said air mixer comprising:

two adjacent sets of air ducts forming airflow passageways for first and second airflows, one of said sets being oriented at a substantial angle, that is less than 180 degrees, to the other of said sets, each air duct having an inlet end and an outlet end, the inlet ends of one set of air ducts being located on a first side of said air mixer, which has a triangular shape when viewed from above, and the inlet ends of the other set being located on a second side of the air mixer, the outlet ends of both sets being located on a third side of the air mixer; and air deflecting vanes for the mixing of said first and second airflows mounted at at least a portion of said outlet ends on said third side, wherein said deflecting vanes in use act to redirect at least a portion of one of said first and second airflows towards the other of said first and second airflows at said third side of the air mixer.

16. An air mixer according to claim 15 wherein said air deflecting vanes are curved and are fixedly mounted to the air ducts at a portion of said outlet ends.

17. An air mixer according to claim 16 wherein each set of air ducts forms at least several spaced apart levels of air ducts with the levels of one set alternating with the levels of the other set.

18. An air mixer according to claim 17 wherein a portion of said deflecting vanes curve upwardly so as to redirect the airflow exiting from adjacent outlet ends upwardly and a remaining portion of the deflecting vanes curve downwardly so as to redirect the airflow exiting from adjacent outlet ends downwardly.

* * * * *